United States Patent [19]

Gwathney et al.

[11] 4,424,740

[45] Jan. 10, 1984

[54] COMPACTOR SAFETY INTERLOCK MECHANISM

[75] Inventors: Kenneth W. Gwathney; George K. Carpenter, both of Vernon, Ala.

[73] Assignee: Marathon Equipment Company, Vernon, Ala.

[21] Appl. No.: 329,337

[22] Filed: Dec. 10, 1981

[51] Int. Cl.[3] ..... B30B 15/16

[52] U.S. Cl. ..... 100/52; 100/53; 100/99; 100/215; 100/229 A; 100/233; 200/61.62; 200/61.7

[58] Field of Search ..... 100/50, 52, 53, 99, 100/233, 215, 229 A; 200/61.63, 61.62, 61.7

[56] References Cited

U.S. PATENT DOCUMENTS

| | | | |
|---|---|---|---|
| 843,805 | 2/1907 | Granger | 200/61.63 |
| 1,174,142 | 3/1916 | Harris | 200/61.62 |
| 2,642,504 | 6/1953 | Hascall | 200/61.7 |
| 3,916,782 | 11/1975 | Booton | 100/50 X |
| 4,005,648 | 2/1977 | Edwards | 100/229 A X |
| 4,018,148 | 4/1977 | Wolbrink | 100/229 A |
| 4,073,228 | 2/1978 | Henzl | 100/229 A X |
| 4,235,165 | 11/1980 | Fenner | 100/53 |

*Primary Examiner*—Billy J. Wilhite
*Attorney, Agent, or Firm*—Shlesinger, Arkwright, Garvey & Fado

[57] ABSTRACT

A compactor safety interlock mechanism including a support with the support including a trash container receiving means and a compactor mechanism, the compactor mechanism including a door opening for receiving the trash and a door for said door opening, outlet means in the compactor mechanism dispensing trash into a trash container when the trash is put into the door opening, ram means in the compactor mechanism having up and down positions movable from a compactor mechanism from above the door opening, past the door and into a trash container when positioned in the support, interlock means associated with the support responsive to a trash container when the trash container is in proper position in the support for activating the ram, latch means for maintaining the door locked when the ram is in down position and for unlocking the door when the ram is in up position, control means associated with the door for deactivating the ram when the door is opened and for activating the ram when the door is closed, means interconnecting the control means with the interlock means for maintaining the ram deactivated when a trash container is not properly positioned in the support, and ram moving means for moving the ram when the ram is activated, whereby, when a trash container is in proper position in the support and the door is latched, the ram is activated and the ram will move from up to down position compacting trash container upon operation of the ram moving means.

17 Claims, 13 Drawing Figures

COMPACTOR SAFETY INTERLOCK MECHANISM

This invention relates to compactors and more specifically to safety interlock mechanisms for use with a compactor of a type described in U.S. Pat. No. 4,235,165, Fenner et al issued Nov. 25, 1980.

HISTORICAL BACKGROUND

Prior art compactors such as described in U.S. Pat. No. 4,235,165 have had problems in that the user would be able to insert trash into the door opening when the container was not in position. This resulted in trash accumulating underneath the compactor and required the operator to pick up the trash lying on the ground. Further, the earlier developments did not provide for means which would deactivate the motor mechanism for driving the ram during certain periods such as when the door was opened, or when the container was not positioned. Additionally, the operator would not be able to know when he was overfilling the container. The ram would continue cramming more material into the container resulting in refuse heaping above the top of the container causing serious spillage when a container was withdrawn.

OBJECTS AND SUMMARY

It is an object of this invention to provide a compactor safety interlock mechanism which is easy to manufacture and install.

It is another object of this invention to provide a safety mechanism for compactors which will prevent injury to the operator due to the fact that the door must be maintained closed when the ram unit is operating.

Yet another object of this invention is to provide a positive safety mechanism which will not operate until a container is in proper position beneath the compactor unit.

Another object of this invention is to provide an interlock system which will be pressure responsive for controlling the amount of trash loaded into a container.

Still a further object of this invention is to provide an override interlock system for the motor mechanism which will deactivate the electrical system at specific times in order to avoid injury or misuse of the system.

Another object of this invention is to provide a compactor system which will be capable of operating under adverse conditions and allow for dimensional changes in equipment due to changes in the installation as for example when the concrete is of poor quality and the anchor bolts securing the compactor change position from first installation.

Another object of this invention is to provide a visual system incorporating lights which will indicate to the operator when the ram is at the top of the container thus signalling to the operator that the container can be removed.

Another object of this invention is to provide a reset mechanism for a compactor which will permit the ram to be automatically reset to zero pressure after the receptacle has been removed and reinstalled for operation.

A further object of this invention is that the mechanism prevents the door from being opened at all times except when the unit is in proper feeding position further increasing the safety of the operator.

Another object of this invention is that the mechanism prevents the unit from operating or cycling when the door is open further increasing the safety of the operator.

Still another object of this invention is that the mechanism prevents the unit from functioning when the trash container is not in the proper position further increasing the safety of the operator.

Yet a further object of this invention is that the mechanism prevents the trash container from overfilling allowing greater ease for emptying the container and eliminating unnecessary repairs to the unit.

In summary, this compactor safety interlock mechanism is designed for more efficient use and greater safety to the operator.

These and other objects of this invention will be apparent from reading of the following description and claims.

In the accompanying drawings which illustrate by way of example various embodiments of this invention:

FIGS. 1 THROUGH 4

The compactor mechanism M as generally shown in FIGS. 1 through 4 includes a container or receptacle R positioned beneath the compactor unit C. The compactor C is mounted upon supports 2 which engage the ground and would normally be secured in concrete or otherwise positively positioned. The supports 2 are braced by cross-beams 4 and 6. It is to be noted that the cross-beams 4 are inclined downwardly from front to rear and that the container R is also inclined downwardly from front to rear for ease in removal of the receptacle or container R.

The container R may include tricycle wheels 8 or any other mechanism such as skids or the like for ease in handling.

Figure 2:
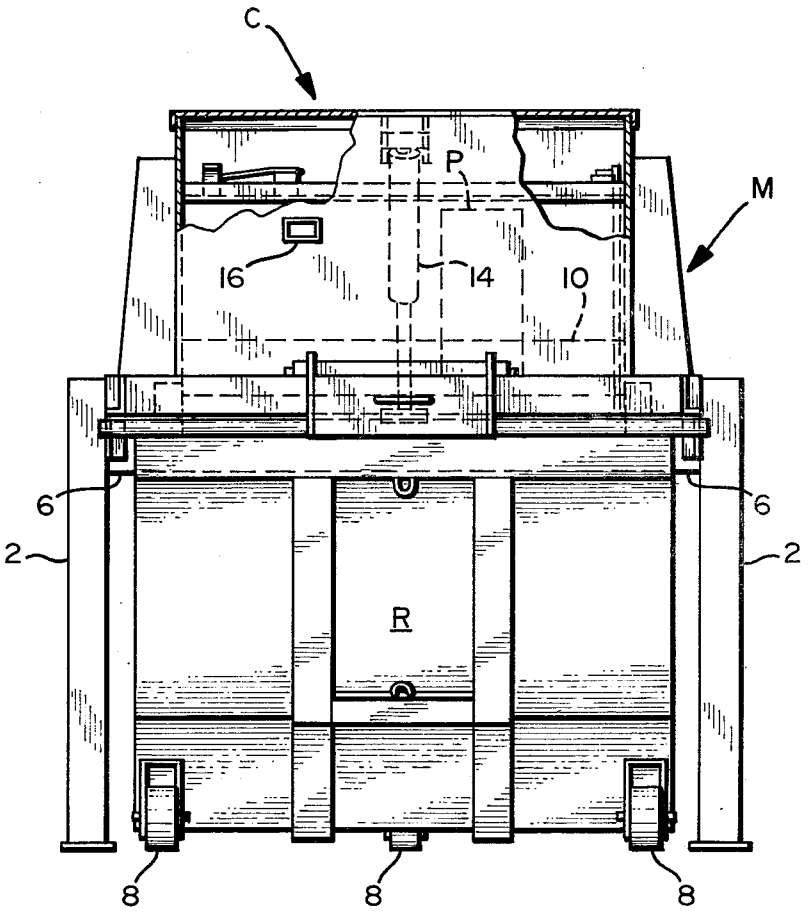
FIG. 2 is a front elevational view of the unit shown in FIG. 1 with portions broken away.
Figure 1:
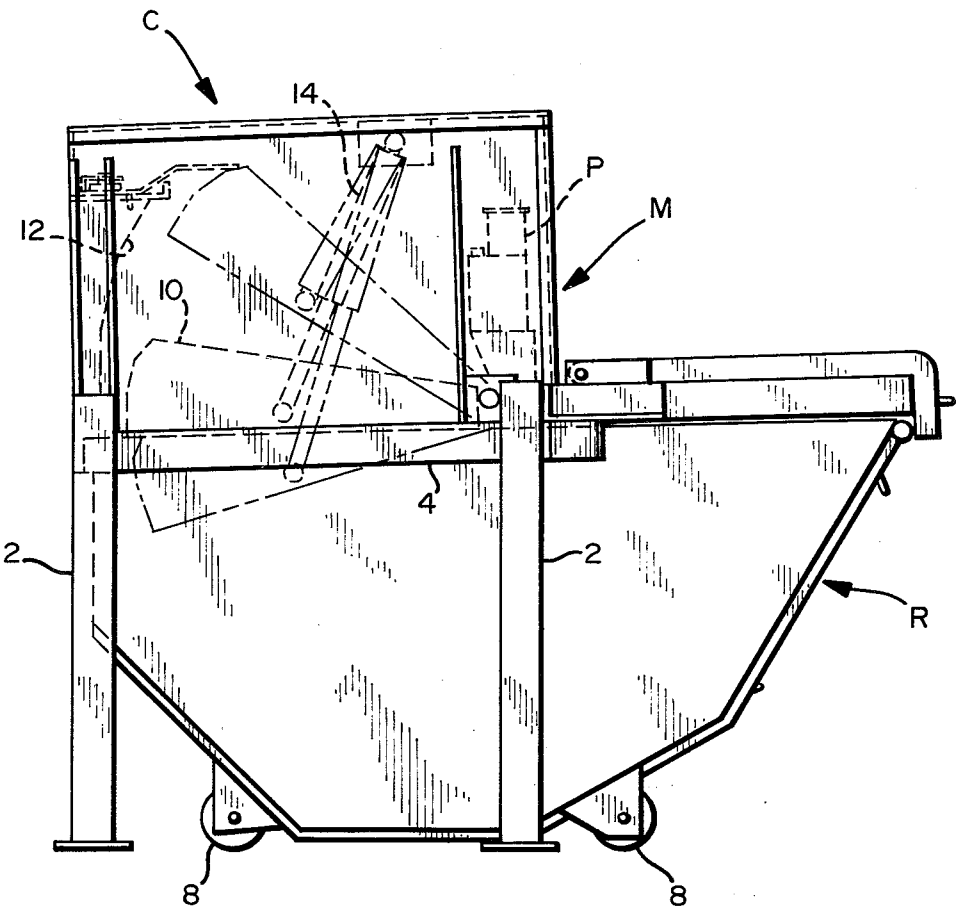
FIG. 1 is a side elevational view showing the trash container in position beneath the compactor with portions of the mechanism in phantom lines and portions broken away.
Figure 4:
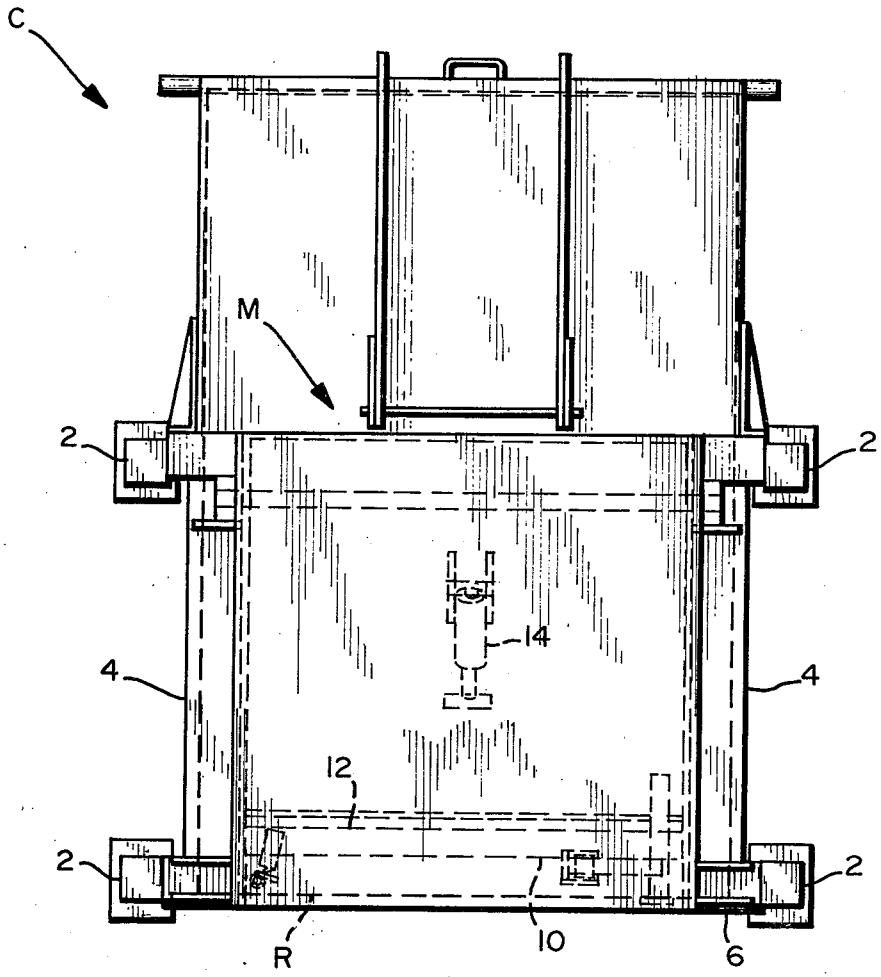
FIG. 4 is a top plan view thereof.

A ram 10 is operable from an up to a down position best shown in FIG. 1. An intermediate position is the normal position that the ram rests in after cycling for compacting. The full up position shown in FIG. 1 would be the position of the ram 10 when the door 12 may be opened.

A power unit P electrically controls a motor mechanism (not shown) for operating the piston cyclinder 14 connected to the ram 10.

The compactor C has an indicating light for the operator of the trash container R pickup operator to indicate that the ram 10 is in the raised mid position. If the indicating light 16 is on green, the receptacle R can be removed by the pickup operator. The operator is informed that the ram 10 is not in proper position for removal of the container R when the light 16 is not on.

Figure 3:
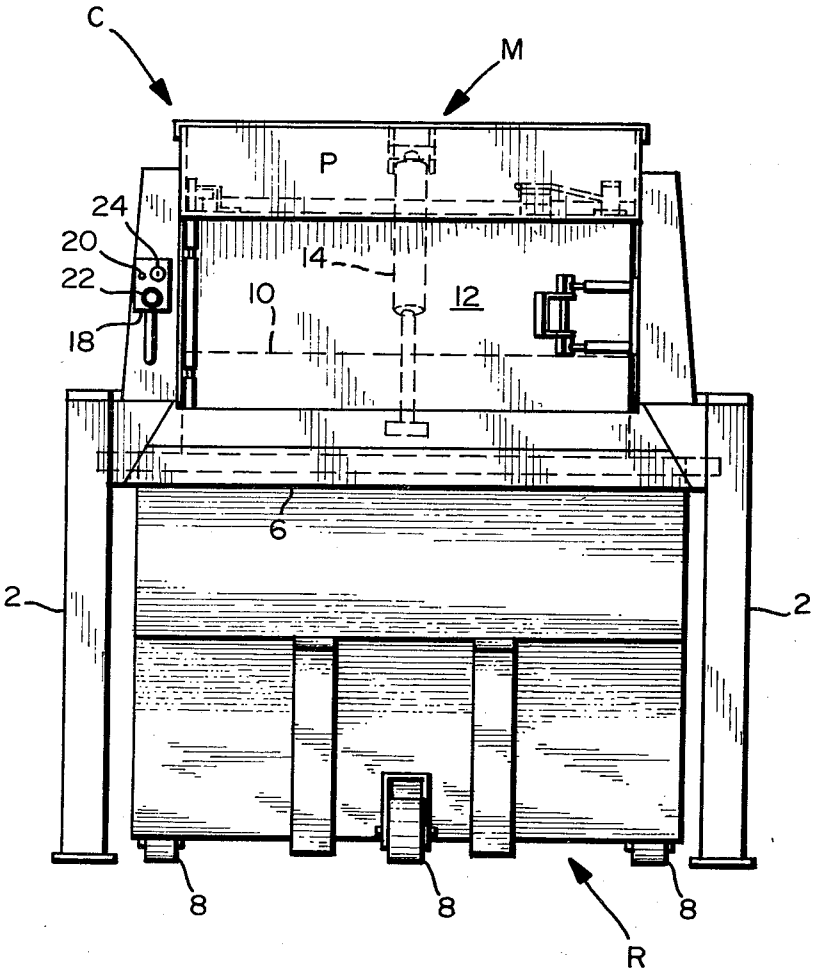
FIG. 3 is a rear elevational view thereof.

As best shown in FIG. 3, a panel 18 is provided for the operator to include a light 20, a push button switch 22, and a key slot 24. The operator turns the compactor mechanism M on by means of a key. Light 20 indicates when the ram 10 is in full up position so that the door 12 may be opened. Upon subsequent closing of the door 12, the operator can cause the ram 10 to compact the material in the receptacle R when button 22 is pushed.

The power unit P is provided with a sensing mechanism (not shown) which is set to a predetermined pressure so that the ram 10 will cease operation when a certain amount of material is compacted in the receptacle R. A certain amount of spring back will result after compaction of the material by the ram 10. If the ram 10 puts too much material into the receptacle R, then the amount of spring back will be sufficient to cause the receptacle R to overflow upon removal thereof. The amount of pressure compaction can be regulated through the power unit P. After a compaction cycle, the ram 10 returns to mid-position above the trash in the receptacle R maintaining the trash in the receptacle prior to withdrawal by the operator.

FIGS. 5 THROUGH 7

Beneath the compactor unit C, and in the area provided between the supports 2 and the cross-beams 4 and 6, an interlock mechanism 26 is mounted. The interlock mechanism 26 included brackets 28 and 30. Bracket 28 supports a microswitch 32 mounted on posts 34 which carry spring members 36. Microswitch 32 is movable on the posts 34 against the spring members 36 to allow for take up depending upon the variations in heights of the containers R which might be inserted in the compactor mechanism M such as might result from variations in the ground or floorings supporting the container R. Bracket 30 supports a plunger 38 which is engageable with the microswitch 32. The base of the plunger passes through a slot 40 and into the area into which a receptacle R is positioned. A cam lever 42 is secured to the plunger 38 by welding or some other means and is engageable by the container R when the container R is in full rearward position within the compactor mechanism M. The container R will cam the cam lever 42 upwardly and in turn move the plunger 38 against the microswitch 32 activating the same. The microswitch 32 includes electrical wiring (not shown) to the power unit P as well as to the indicator light 16.

Figure 7:
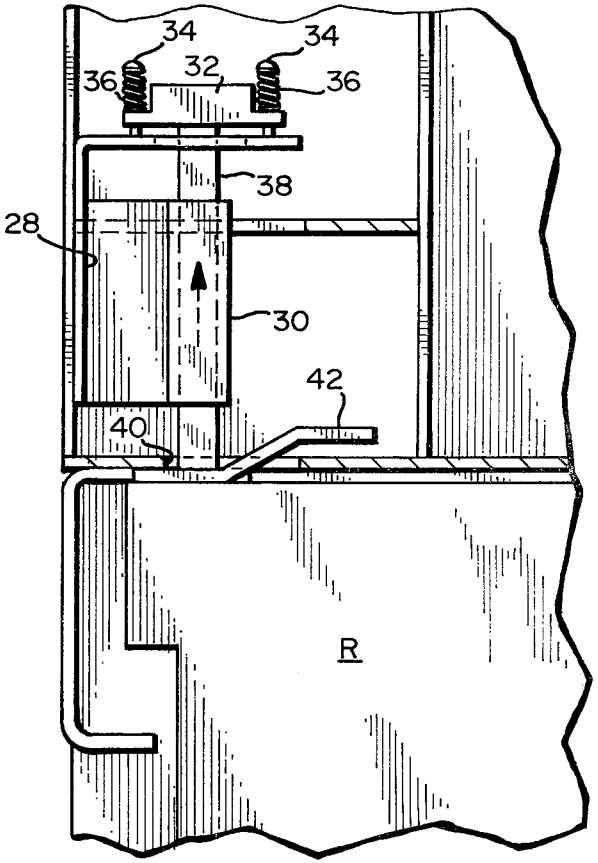
FIG. 7 is a fragmentary cross-sectional view similar to FIG. 6 but showing the switch plunger operator in raised position.
Figure 6:
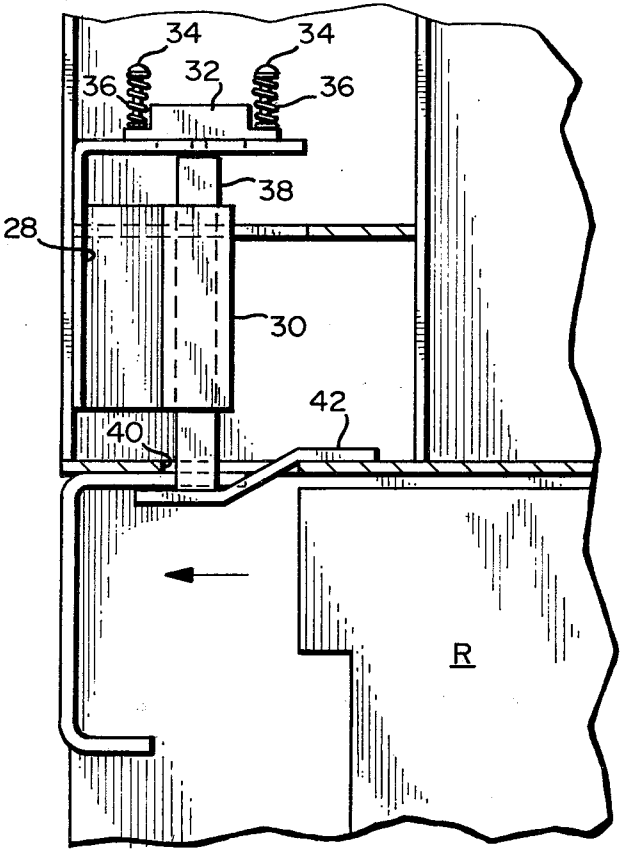
FIG. 6 is a cross-sectional view taken along the lines 6—6 of FIG. 5 and viewed in the direction of the arrows and showing a receptacle in phantom lines being moved into position for operation of the interlock.
Figure 5:
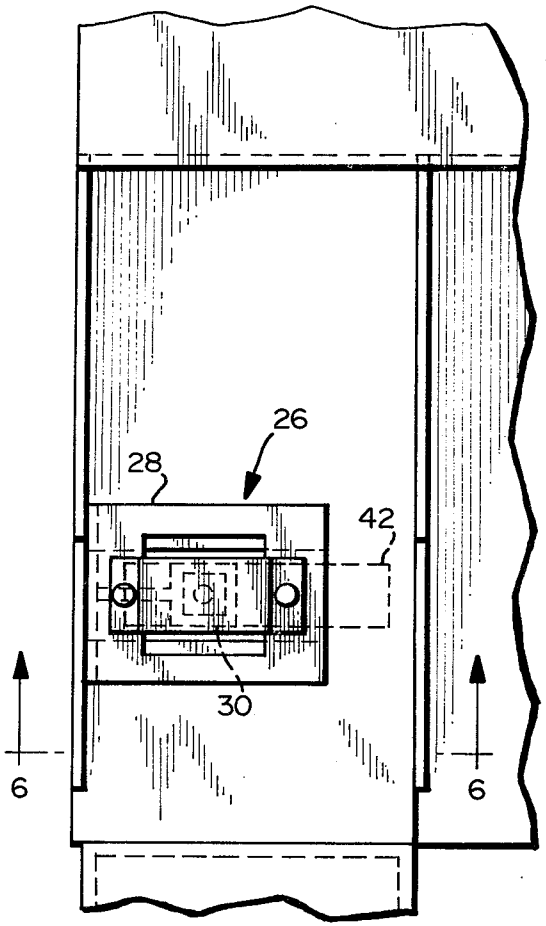
FIG. 5 is a fragmentary enlarged bottom plan view of the interlock means.

FIG. 6 shows the interlock mechanism 26 in the down position prior to the engagement of the upper portion of the container R with the cam lever 42. FIG. 7 shows the receptacle R in proper position having cammed the plunger 38 upwardly into engagement with the microswitch 32 for purposes hereinafter disclosed.

Figure 10:
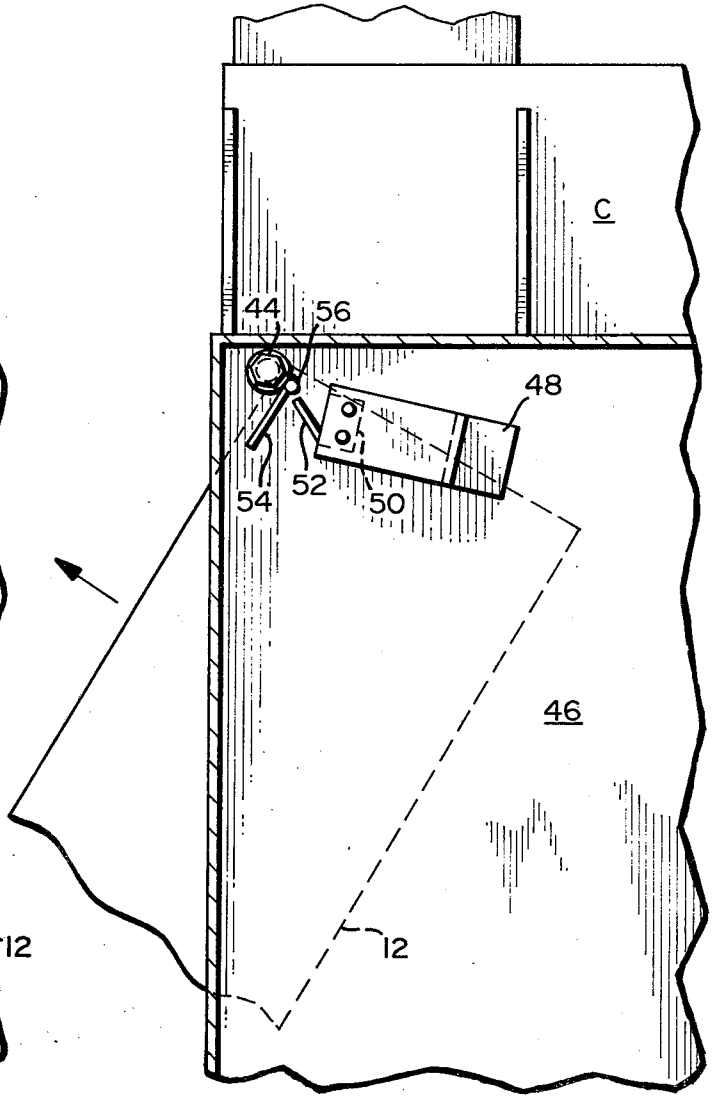
FIG. 10 is an enlarged fragmentary top plan view similar to FIG. 9 with the door shown in partially opened position.
Figure 9:
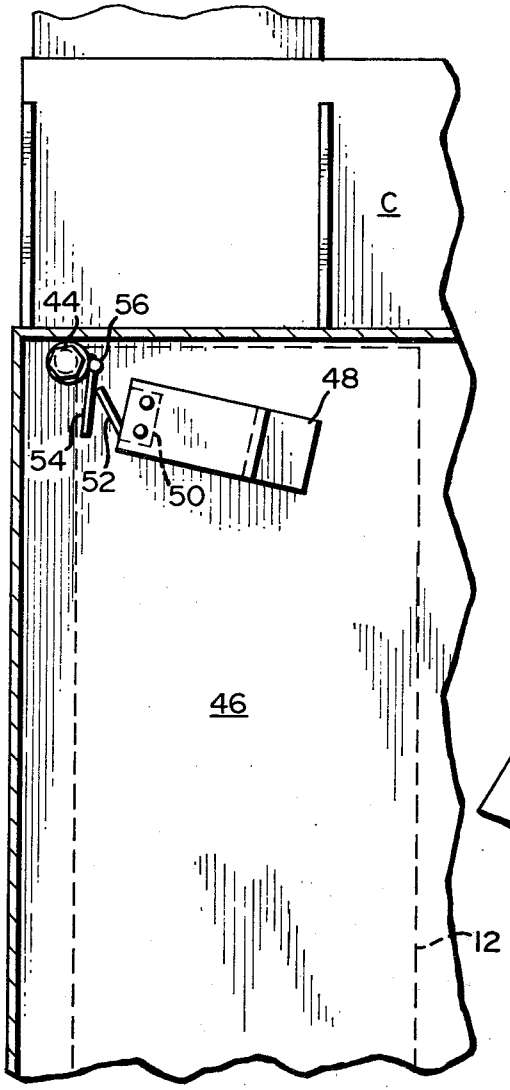
FIG. 9 is an enlarged fragmentary top plan view of the hinge door lock mechanism with the door in closed position.
Figure 8:
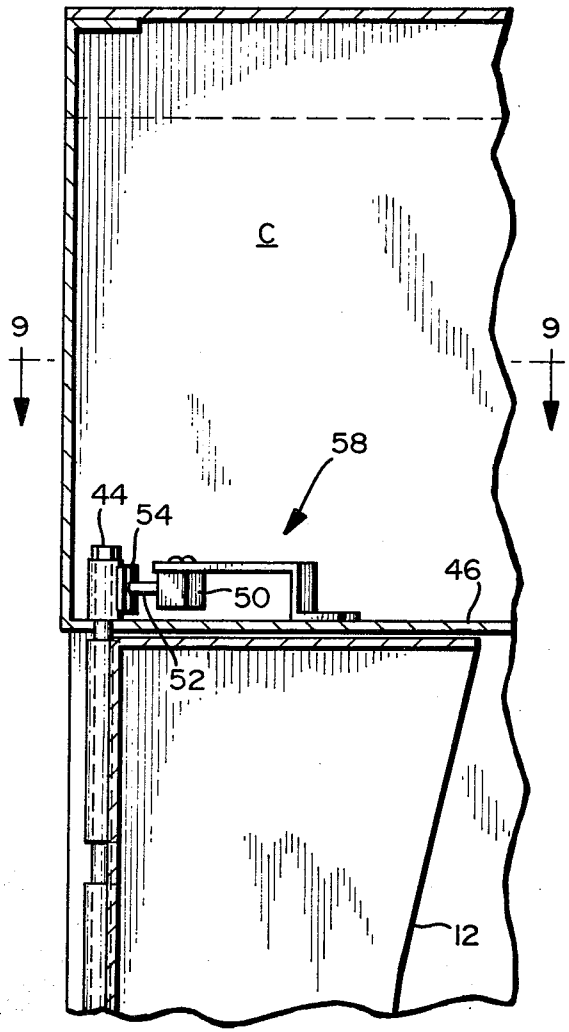
FIG. 8 is an enlarged fragmentary cross-sectional view of the door hinge switch mechanism.

FIGS. 8, 9 and 10

The door 12 is mounted on the rear of the compactor unit C and pivots on a pintle 44. Mounted above the door 12 and on the wall or jam 46 above the door 12 is a bracket 48 supporting a microswitch 50. The microswitch 50 includes an operator 52 for engagement with a leaf hinge 54 pivoting on a pivot pin 56.

As shown best in FIG. 9, the leaf hinge 54 engages with the operator 52 of the microswitch 50. When the door 12 is opened, the leaf 54 disengages from the operator 52 of the microswitch 50. It should be noted that the pivot pin 56, which is secured to the pintle 44, rotates through an arc of appoximately 175 degrees when the door 12 moves from full open position to full closed position and that the microswitch 50 does not function until just before full closure of the door 12.

Figure 11:
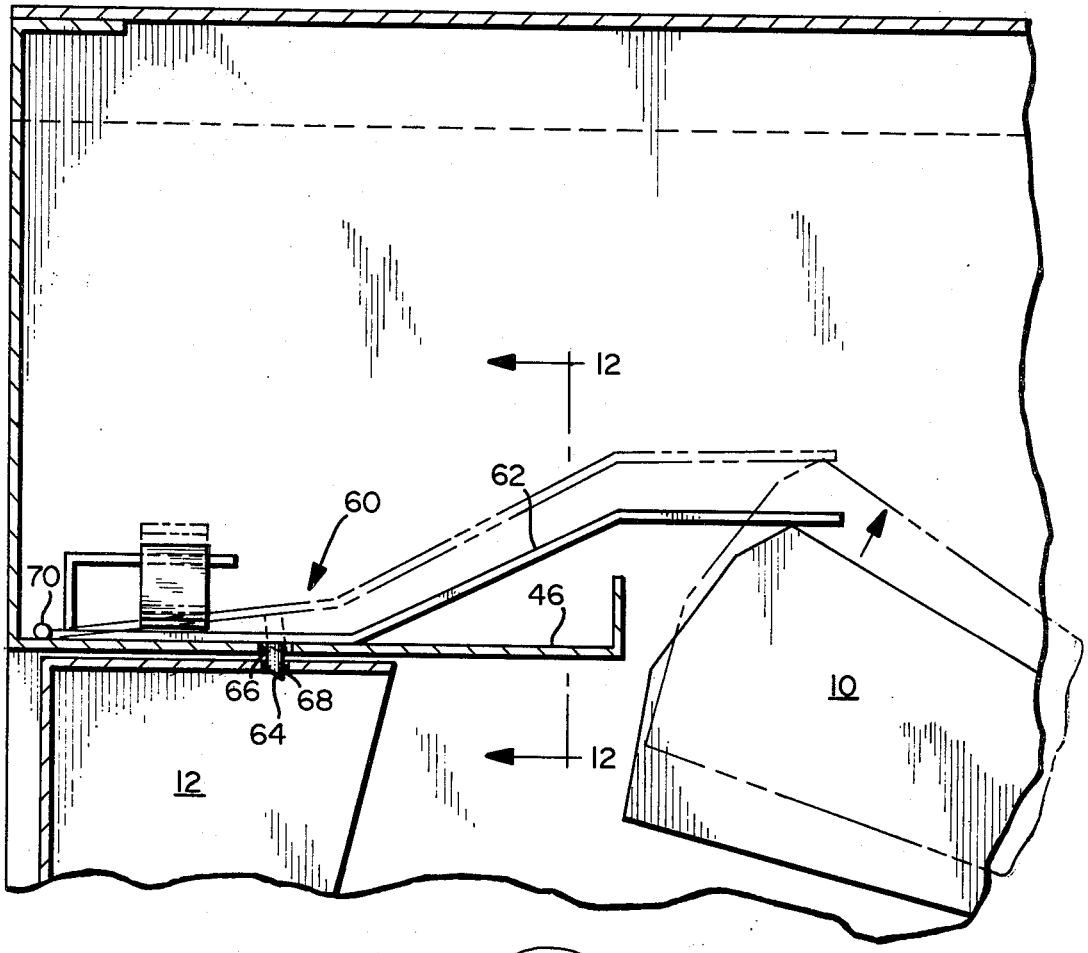
FIG. 11 is an enlarged fragmentary cross-sectional view showing the door closed and a door latch mechanism in down position in solid lines and in raised position in broken lines.
Figure 12:
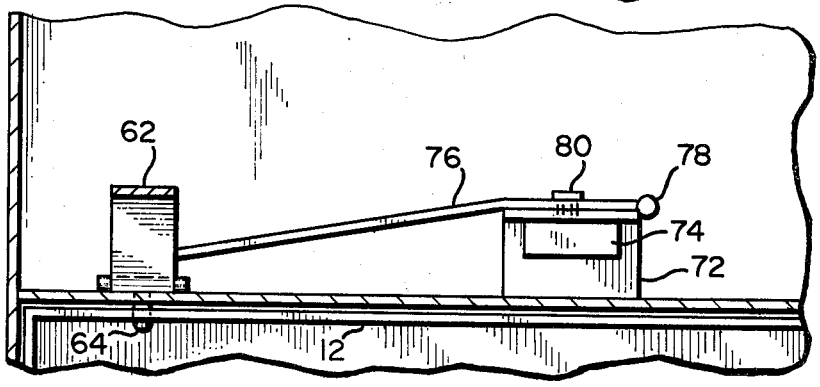
FIG. 12 is an enlarged fragmentary cross-sectional view of the latch mechanism taken along the lines of 12—12 of FIG. 11 and viewed in the direction of the arrows.
Figure 13:
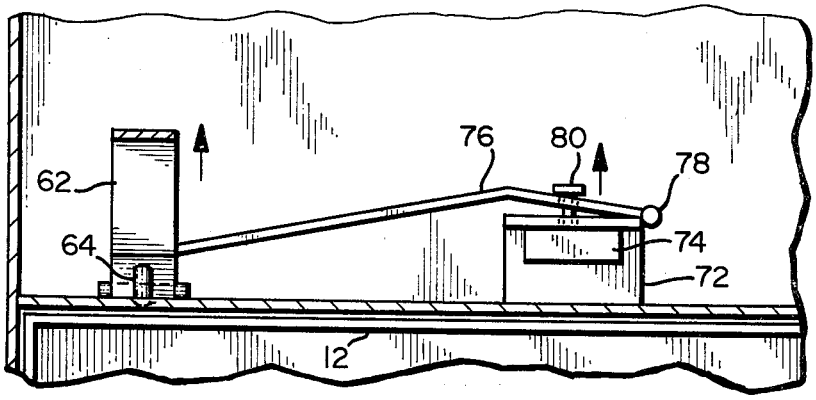
FIG. 13 is an enlarged cross-sectional view similar to FIG. 12 showing the latch mechanism in raised position.

FIGS. 11, 12 and 13

Mounted above the door 12 and spaced from the control means 58 generally indicated in FIGS. 8, 9 and 10, is a latch 60. The latch 60 includes a lever 62 of a generally S-configuration. The lever 62 includes a pin 64 passing through an opening 66 into the wall 46 and into a keeper opening 68 in the door 12. One end of the lever 62 is engageable with the ram 10 and the other end of the lever 62 is pivoted about a hinge 70 mounted on the wall 46. To one side of the lever 62, a bracket 72 is positioned. Mounted on the bracket 72 is a microswitch 74. A lever 76 is provided with a hinge 78 on the bracket 72. A microswitch operator 80 is mounted above the microswitch 74. The far end of the lever 76 engages the lever 62 so that when the lever 62 is raised by the ram 10, the lever 76 will be pivoted about the hinge 78 to raise the microswitch operator 80 to disengage it from the microswitch 74 on the bracket 72.

It will be noted in FIG. 12 that the lever 62 is in the hold down position and that the pin 64 engages the keeper opening 68 when the ram is in the lower position. When the ram is in the upper position, as shown in FIG. 13, the lever 62 moves the lever 76 upwardly and the pin 64 is moved out of the keeper opening 68 to allow the door 12 to be opened.

OPERATION

The operation of a compactor mechanism M is as follows:

With the container R in proper position within the compactor mechanism M, the control means 58 operates to activate the power unit P. When the door 12 is closed, and the push button 22 is manually pushed, the ram 10 will descend into the container R for compacting whatever trash is therein. If the container R is not in place, the compactor unit C will not cycle. When the container R is filled with compacted refuse, an indicating light 16 goes on. The indicating light 16 is connected to a pressure sensing device in the power unit P which is tied into the piston cyclinder 4 so that at a predetermined pressure, the power unit P will position the ram 10 at intermediate position above the container R and shut down the power to the ram 10 while activating the indicator light 16 so that the operator picking up the container R will be able to remove the same from the compactor mechanism M.

The compactor mechanism M is normally positioned against an opening in a building so that maintenance personnel in the building can have access to the door 12 through the opening in the building. When the maintenance personnel desire to dispose of trash, they go to the compactor mechanism M. They will insert a key into the key slot 24 of the panel 18 which will turn on power to the power unit P and cause the ram to cycle downwardly for compaction through a cycle. When the button 22 is pushed by the operator, the ram 10 will move upwardly into the up position at the same time moving the lever 62 to move the pin 64 from out of the keeper opening 68. The microswitch 74 simutaneously deactivates the power to the ram 10. The door 12 is now opened by the maintenance personnel for insertion of the trash into the compactor unit C. Pushing the button 22 reactivates the ram and permits it to descend through a compacting cycle and to come to rest after the compacting cycle at the intermediate position of just above the receptacle R. To open the door, the button 22 must be pushed a second time to cause the ram to ascend and release the latch 60.

Because the power unit P is set at a defined compacting pressure, an override is necessary to reset the power unit P so that the ram 10 will again be ready for compacting. This occurs when the receptacle R, after removal and emptying, is again positioned in the compactor mechanism M so as to engage the interlock mechanism 26. At this time, the power unit P is again activated to permit the ram to be operated by the maintenance personnel once the key has been inserted into the slot 24.

While this invention has been described as having a preferred design, it will be understood that it is capable of further modification. This application, is therefore intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

Having thus described our invention, what we claim is:

1. A compactor safety interlock mechanism including:

(a) a support;

(b) said support including trash container receiving means and a compactor mechanism;

(c) said compactor mechanism including a door opening for receiving trash and a door for said door opening;

(d) outlet means in said compactor mechanism for dispensing trash into a trash container when trash is put into said door opening;

(e) ram means in said compactor mechanism, having up, down, and intermediate positions and movable from said compactor mechanism from above said door opening past said door and into a trash container when positioned in said support;

(f) interlock means associated with said support responsive to a trash container when a trash container is in proper position in said support for activating said ram;

(g) latch means for maintaining said door locked when said ram is in a down position and for unlocking said door when said ram is in said up position;

(h) control means associated with said door for deactivating said ram when said door is open and for activating said ram when said door is closed;

(i) means interconnecting said control means with said interlock means for maintaining said ram deactivated when a trash container is not properly positioned in said support;

(j) ram moving means for moving said ram when said ram is activated;

(k) said trash container receiving means including a front and a rear;

(l) said interlock means being mounted at said rear of said trash container receiving means;

(m) said interlock means including movable cam means operable by a trash container when in proper position;

(n) switch means associated with said cam means engageable by said cam means when said cam means is moved;

(o) said switch means including take up means to prevent damage to said switch means by over travel of said cam means; and, (p) whereby when a trash container is in proper position in said support and said door is latched, said ram is activated and said ram will move from up to down position compacting trash in said trash container upon operation of said ram moving means.

2. A compactor safety interlock mechanism as in claim 1 and wherein:

(a) said trash container receiving means slopes downwardly from front to rear for receiving a wedge-shaped trash container.

3. A compactor safety interlock mechanism as in claim 1 and wherein:

(a) said control means associated with said door includes a pintle;

(b) said pintle rotatable with said door;

(c) a means mounted on said pintle and rotatable therewith;

(d) a control switch mounted on said support adjacent said door;

(e) said means on said pintle engageable with said switch when said door is closed.

4. A compactor safety interlock mechanism as in claim 3 and wherein:

(a) said means mounted on said pintle includes a hinged switch contact plate.

5. A compactor safety interlock mechanism as in claim 4 and wherein:

(a) said hinged switch contact plate includes a portion moveable through at least 90°.

6. A compactor safety interlock mechanism as in claim 4 and wherein:

(a) said hinged switch contact plate includes a portion moveable through about 170° and includes a reciprocating portion.

7. A compactor safety interlock mechanism as in claim 1 and wherein:

(a) said latch means includes a lever, and mounted on said compactor mechanism;

(b) a bolt on said lever;

(c) said lever engageable with said ram;

(d) a keeper on said door for said bolt;

(e) said bolt normally engaging said keeper when said ram is in down position and removed from said keeper when said ram is in up position.

8. A compactor safety interlock mechanism as in claim 7 and wherein:

(a) said keeper includes an opening in said door for said bolt to engage.

9. A compactor safety interlock mechanism as in claim 8 and including:

(a) backup switch mounted on said compactor mechanism adjacent said lever; and (b) means on said lever for operating said backup switch for deactivating said ram when said ram is in said up position and said door is opened and activating said ram when said ram is in said up position and said door is closed;

(c) whereby if said control means should for any reason fail to deactivate said ram when said door is opened, said backup switch will override said control means and maintain said ram deactivated and in the up position.

10. A compactor safety interlock mechanism as in claim 1 and wherein:

(a) said compactor mechanism including said interlock means are electrically interconnected with said ram moving means.

11. A compactor safety interlock mechanism as in claim 1 and wherein:

(a) said support includes a first indicator for informing an operator that the trash container is in proper position and that the door is closed.

12. A compactor safety interlock mechanism as in claim 11 and including:

(a) power on/off means.

13. A compactor safety interlock mechanism as in claim 12 and including:

(a) a push-button for said power on/off means.

14. A compactor safety interlock mechanism as in claim 1 and including:

(a) ram pressure sensing means to deactivate said ram when a predetermined compaction of the trash occurs.

15. A compactor safety interlock mechanism as in claim 14 and wherein:

(a) said ram pressure sensing means includes means for moving said ram to said intermediate position upon reaching said predetermined compaction and prior to deactivation of said ram.

16. A compactor safety interlock mechanism as in claim 15 and including:

(a) a second indicator means on said support for indicating that said ram is in said intermediate position so that said trash container may be removed without interference with said ram.

17. A compactor safety interlock mechanism as in claim 16 and wherein:

(a) said second indicator is a light.

* * * * *